US008041511B2

(12) United States Patent
Riegel et al.

(10) Patent No.: US 8,041,511 B2
(45) Date of Patent: Oct. 18, 2011

(54) METHOD FOR OPTIMIZING CALIBRATION MAPS FOR AN ALGORITHM OF ESTIMATION OF A CONTROL QUANTITY OF AN INTERNAL COMBUSTION ENGINE

(75) Inventors: Alessandro Riegel, Turin (IT); Dario Sacco, Turin (IT); Fabio Garofalo, Turin (IT)

(73) Assignee: Fiat Group Automobiles S.p.A. (IT)

( * ) Notice: Subject to any disclaimer, the term of this patent is extended or adjusted under 35 U.S.C. 154(b) by 242 days.

(21) Appl. No.: 12/329,735

(22) Filed: Dec. 8, 2008

(65) Prior Publication Data

US 2009/0150111 A1 Jun. 11, 2009

(30) Foreign Application Priority Data

Dec. 10, 2007 (EP) ..... 07425782

(51) Int. Cl.
*F02P 5/00* (2006.01)

(52) U.S. Cl. ..... 702/16; 702/105; 123/435; 701/123; 73/61.47

(58) Field of Classification Search ..... 702/105, 702/16; 123/435; 73/61.47; 701/123
See application file for complete search history.

(56) References Cited

U.S. PATENT DOCUMENTS 6,397,152 B1 5/2002 Kalweit et al. ..... 702/41
6,848,421 B1 * 2/2005 Karau et al. ..... 123/406.22

FOREIGN PATENT DOCUMENTS

FR 2 864 162 6/2005
WO WO 2005/103472 11/2005

OTHER PUBLICATIONS

European Search Report mailed May 28, 2008 in corresponding European Application No. 07425782.5.
European Office Communication dated May 28, 2008 for corresponding European Application No. 07425782.
Response to European Communication mailed May 28, 2008 filed on Jul. 19, 2010 with the European Patent Office.

* cited by examiner

*Primary Examiner* — Sujoy Kundu
(74) *Attorney, Agent, or Firm* — Ostrolenk Faber LLP

(57) ABSTRACT

Described herein is a method for optimizing a plurality of calibration maps for an algorithm of estimation of a control quantity of an internal combustion engine, each of the maps comprising a plurality of calibration values of said control quantity estimated by said algorithm. The optimization method comprises measuring the control quantity, estimating the control quantity, and individually optimizing each calibration map based on the measured control quantity and the estimated control quantity.

10 Claims, 5 Drawing Sheets

METHOD FOR OPTIMIZING CALIBRATION MAPS FOR AN ALGORITHM OF ESTIMATION OF A CONTROL QUANTITY OF AN INTERNAL COMBUSTION ENGINE

The present invention concerns a method for optimizing calibration maps for an algorithm of estimation of a control quantity of an internal combustion engine.

BACKGROUND OF THE INVENTION

As is known, modern electronic vehicle engine control units implement a plurality of algorithms that, when the engine is running, estimate engine quantities based on which the electronic control unit controls the engine operation.

These algorithms generally operate by using input quantities, of the motor type for example, generally measured by sensors when the engine is running, and experimentally determined calibration maps, which describe the trend of the quantity estimated by the algorithm, as a function of the quantities on which it depends.

As a rule, before being stored in the electronic control unit, the algorithms are calibrated using the aforementioned maps.

For example, the algorithm for estimating the instantaneous torque supplied by the engine, normally uses the number of engine revs RPM and/or the position of the accelerator pedal as input quantities, both of these detected by suitable sensors, and one or more algorithm calibration maps that describe the trend of supplied torque as a function of the number of engine revs RPM and/or position of the accelerator pedal, with the values of which the algorithm calculates each value of estimated torque.

In particular, the calibration maps of the algorithm are defined by experimentally measuring, on an engine test bench or a rolling road for vehicles, the motor quantities that will be estimated by the algorithm, as a function of the variables on which these depend, for example the torque supplied by the engine can be measured as a function of the number of revs RPM.

Carrying out the measurements of the quantities specified in the calibration maps and the calibration of the control unit's algorithms are operations that require rather long times, are particularly onerous and weigh significantly on the development costs of vehicle control units. Furthermore, the need to implement increasingly complex algorithms in the control units to carry out calculations on the basis of quantities supplied by a plurality of maps makes the process of calibrating the algorithms, consisting in the definition of map values, even longer and more complicated.

In order to simplify the calibration procedure of the algorithms, the following, for example, are known of: use of approximation formulas that describe the physics of the phenomenon to be represented, use of specific programming languages needed to be able to use algebraic formulas via which optimal parameter values can be calculated, or breaking down the algorithms into simpler algorithms and calibrating each one of them using specifically acquired data. For example, if the torque supplied by the engine depends on the product of the output of two calibration maps, usually the representative physical quantities of each of the two maps are measured and then each map is calibrated independently.

However, these solutions have several drawbacks, including:

- the need to carry out specific measurements for calibration of the algorithm,
- the need to carry out the measurements in special environmental and/or engine conditions,

- the use of additional sensors for the acquisition of all the input and output quantities of the maps,
- the propagation of measurement errors in the calibration procedure,
- the poor precision of the simplified formulas utilized for describing the physical phenomenon,
- the imprecision and difficulty of specific programming languages used for implementing the algorithm.

Thus, the need is felt to reduce the number of experimental measurements necessary for obtaining the maps to the bare minimum and to implement an optimization method for the calibration maps of the algorithms that at least partially overcome the drawbacks of the known methods.

SUMMARY OF THE INVENTION

According to the present invention, a method for optimizing calibration maps for an algorithm of estimation of a control quantity of an internal combustion engine is provided, as defined in the attached claims.

BRIEF DESCRIPTION OF THE DRAWINGS

For a better understanding of the present invention, a preferred embodiment shall now be described, purely by way of a non-limitative example and with reference to the enclosed drawings, where.

DETAILED DESCRIPTION OF THE INVENTION

Figure 1:
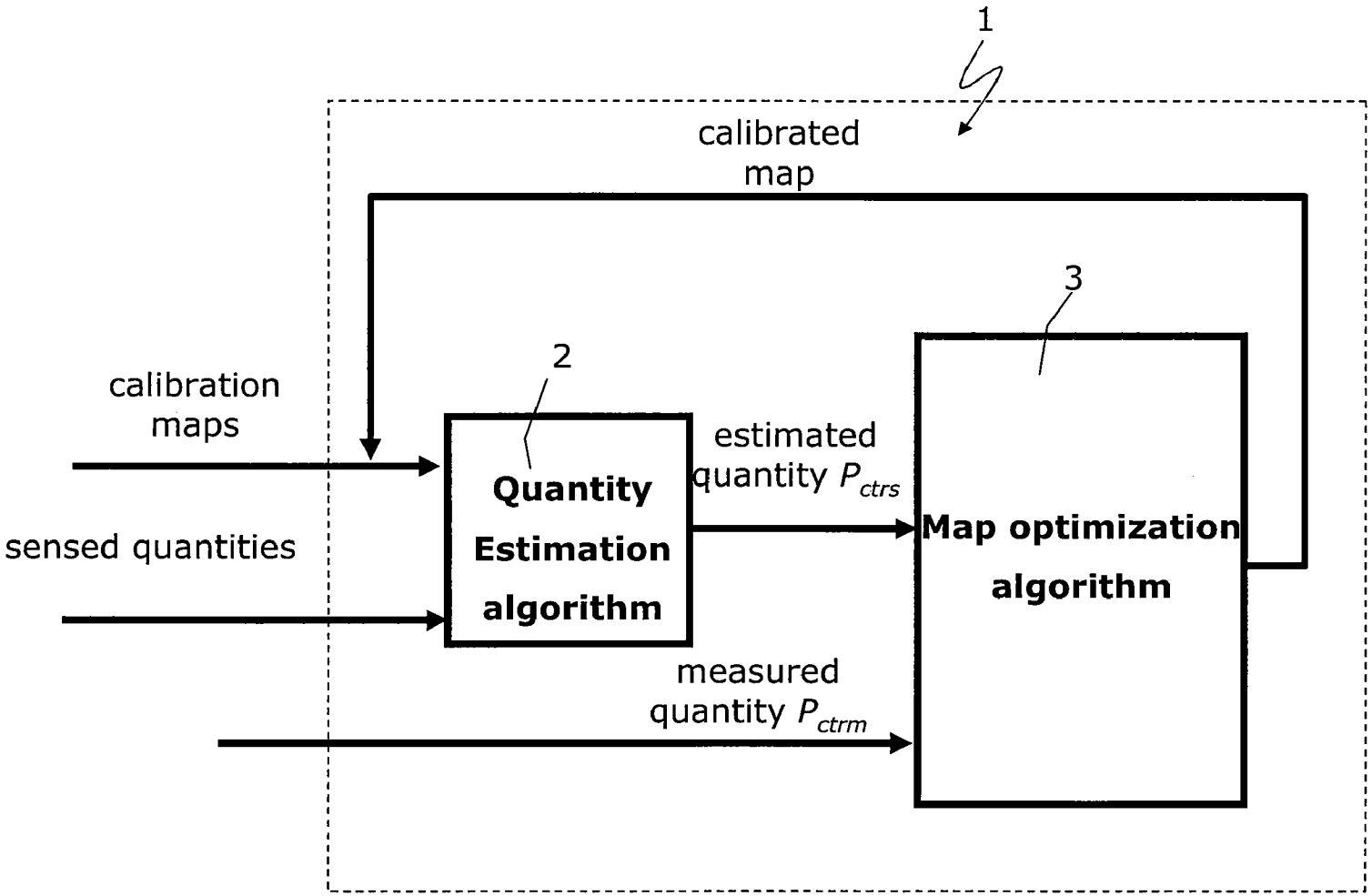
FIG. 1 shows a block diagram of the principle of the invention's calibration map optimization method.

In FIG. 1, reference numeral 1 indicates, in its entirety, an electronic data-processing unit, for example a computer, configured to implement the invention's calibration map optimization method.

In outline, as shown in the block diagram of the principle in FIG. 1, the method of the invention includes:

- storing the calibration maps of at least one estimation algorithm 2 for a control quantity $P_{ctr}$, of the motor type, such as the torque supplied by the engine for example, in the processing unit 1,
- estimating the control quantity $P_{ctr}$, by means of the algorithm 2, on the basis of the calibration maps and the input quantities detected by sensors and upon which the control quantity $P_{ctr}$ to be estimated depends,
- experimentally measuring the control quantity $P_{ctrm}$, and
- implementing a calibration algorithm 3 for the algorithm 2 via the optimization of the calibration maps of the algorithm 2, so as to make the quantity $P_{ctrs}$ estimated by the algorithm 2 as closely approximated to the measured quantity $P_{ctrm}$ as possible.

For example, always with reference to FIG. 1, the method of the invention can be used to calibrate the estimation algorithm for the torque supplied by the engine, implemented by the electronic control unit for engine control through the optimization of the calibration maps for the torque estimated by said algorithm, these also stored in the electronic control unit and used by the algorithm to perform the torque estimate.

Figure 2:
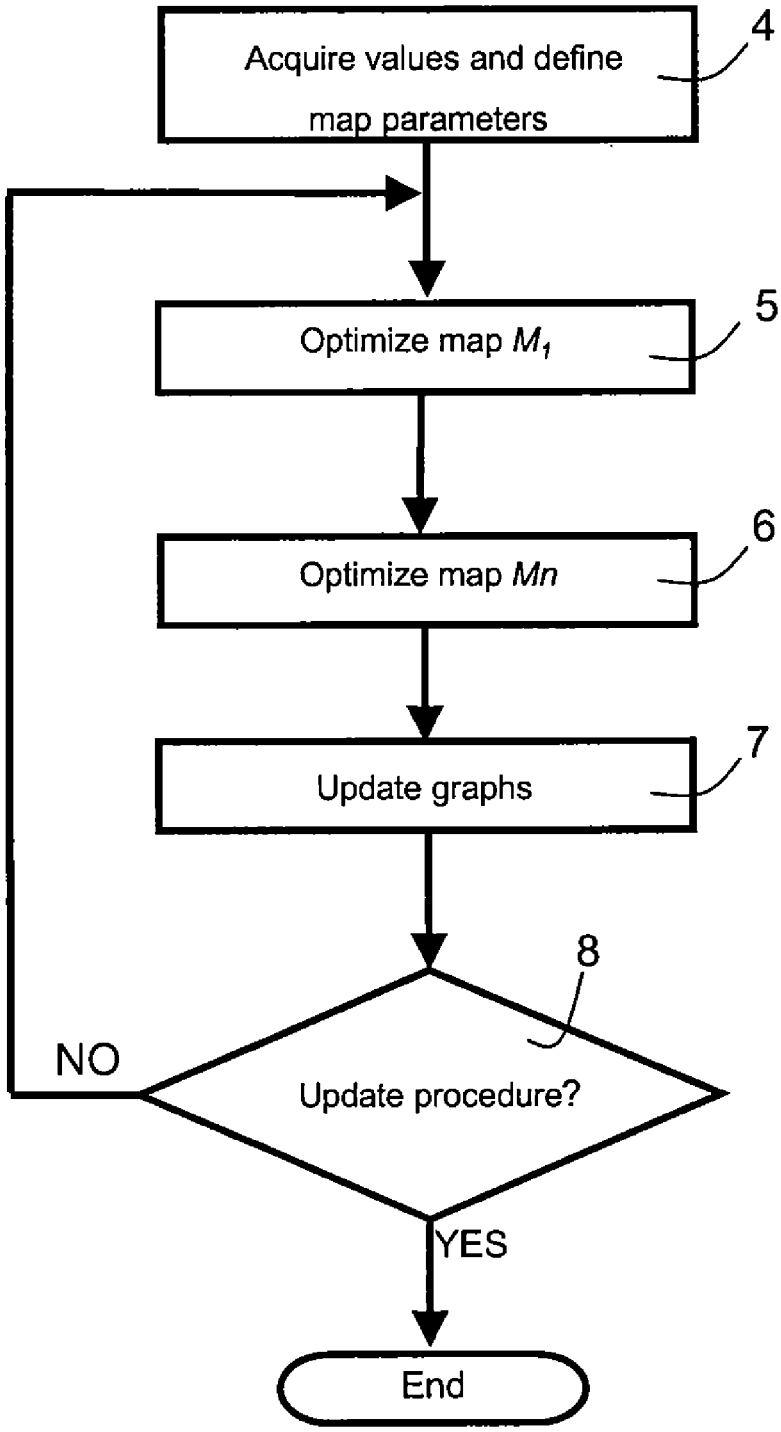
FIG. 2 shows a flowchart of the invention's calibration map optimization method.

In particular, as shown in the flowchart in FIG. 2, in an initial phase of the method, block 4, the characteristic parameters of each stored calibration map are acquired, more specifically:

- the values of the input quantities $P_i$ of the map and the corresponding calibration values $P_{clb}$ associated with them,
- and, in the case of multidimensional maps in which the calibration quantity $P_{clb}$ represented in the map depends on more than one input quantity $P_i$,
- the calibration values $P_{clb}$ in function of all the input quantities and the corresponding values of the input quantities $P_i$ associated with them.

For example, if it is wished to optimize the map $M_1$ that represents the trend of torque $C_e$ supplied by the engine as a function of the number of engine revs RPM, the map $M_2$ that represents the trend of torque $C_e$ supplied by the engine as a function of the accelerator pedal position $\eta$ and the map $M_3$ that represents the trend of torque $C_e$ supplied by the engine as a function of the number of engine revs RPM and accelerator pedal position $\eta$, the following will be acquired and stored in this phase of the method:

- from map $M_1$, the calibration torque $C_{e\text{-}RPM}$ values and the corresponding RPM values associated with them,
- from map $M_2$, the calibration torque $C_{e\text{-}\eta}$ values and the corresponding $\eta$ values associated with them, and
- from map $M_3$, the calibration torque $C_{e\text{-}RPM\text{-}\eta}$ values and the corresponding RPM and $\eta$ values associated with them.

For each map, always in said initial phase of the method, map-delimiting parameters are also defined, or rather, more specifically:

- a minimum variation De allowed for each value of each input quantity, and for each calibration value $P_{clb}$ specified on the map, for example 0.1 or 0.05,
- a minimum value Min allowed for each input quantity $P_i$ and for the calibration value $P_{clb}$, for example RPM=1000 rpm in map $M_1$, or C=0 Nm in maps $M_1$, $M_2$ and $M_3$, and
- a maximum value Max allowed for each input quantity $P_i$ and for the calibration value $P_{clb}$, for example RPM=8000 rpm in map $M_1$, or C=200 Nm in maps $M_1$, $M_2$ and $M_3$.

Once the initialization phase described in block 4 is completed, in block 5 of FIG. 2 the processing unit 1 performs an optimization procedure on each map. In particular, the calibration maps are individually optimized, one by one, starting from map $M_1$ for example, and proceeding, as shown in block 6 in FIG. 2, with map $M_2$ and so on until all calibration maps have been optimized. The procedure shown in FIG. 2 will be repeated, starting from the first map $M_1$ until interrupted by an operator.

The optimization procedure for each map shall now be described with reference to the flowchart in FIG. 3 and the diagram in FIG. 4.

Figure 3:
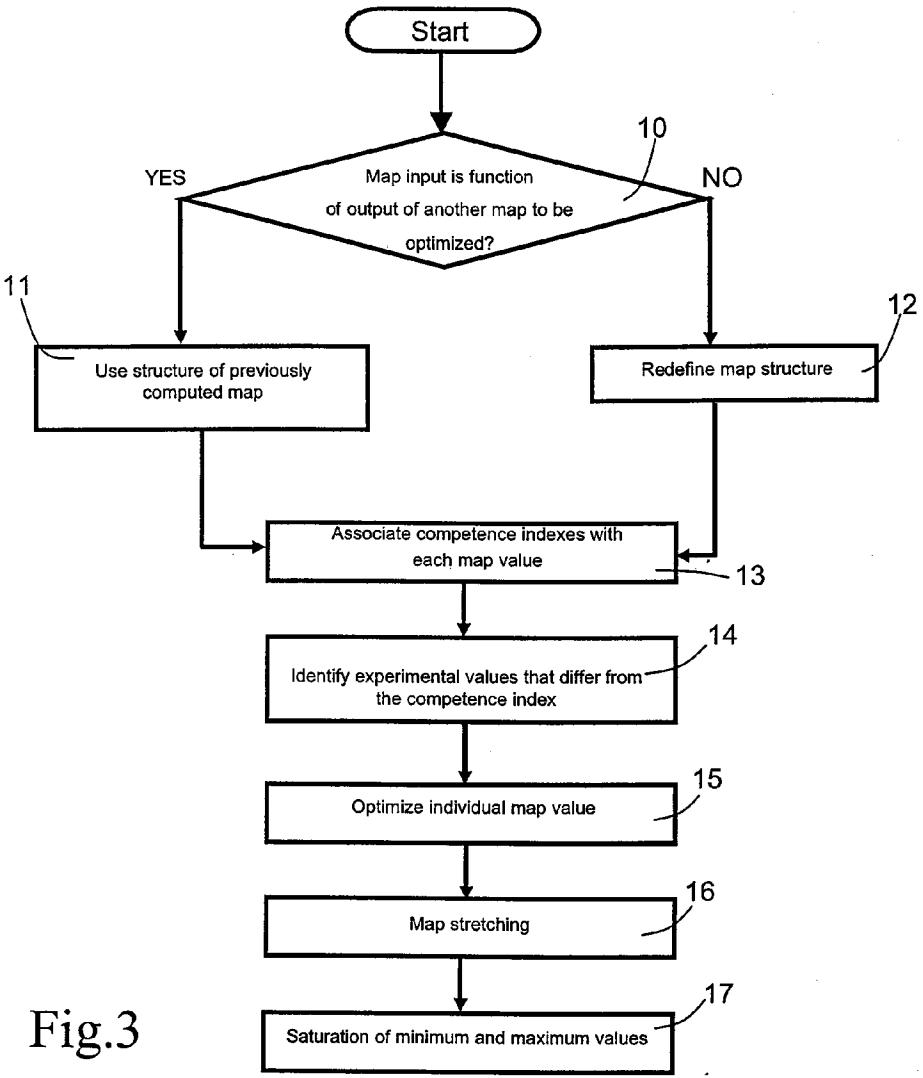
FIGS. 3 and 5 show more detailed flowcharts of the invention's calibration map optimization method.

In particular, as shown in block 10 in FIG. 3, the processing unit 1 first of all checks whether the input quantities $P_i$ of the map $M_n$ to optimize depend on the values of a calibration quantity $P_{clb}$ of a previously calibrated map $M_{n-1}$. If this is not the case, the NO exit is taken from block 10 and, with reference to FIG. 4, the processing unit 1 distributes the calibration values $P_{clb}$ of map $M_n$ (for example, the calibration values of torque supplied by the engine) inside a system of Cartesian axes, and associates certain respective competence indices $I_C$ with each value of the calibration quantity $P_{clb}$, so as to create a structure of map $M_n$, defined by areas $A_n$ of competence (block 12), each one delimited by a plurality of competence indices $I_C$.

Figure 4:
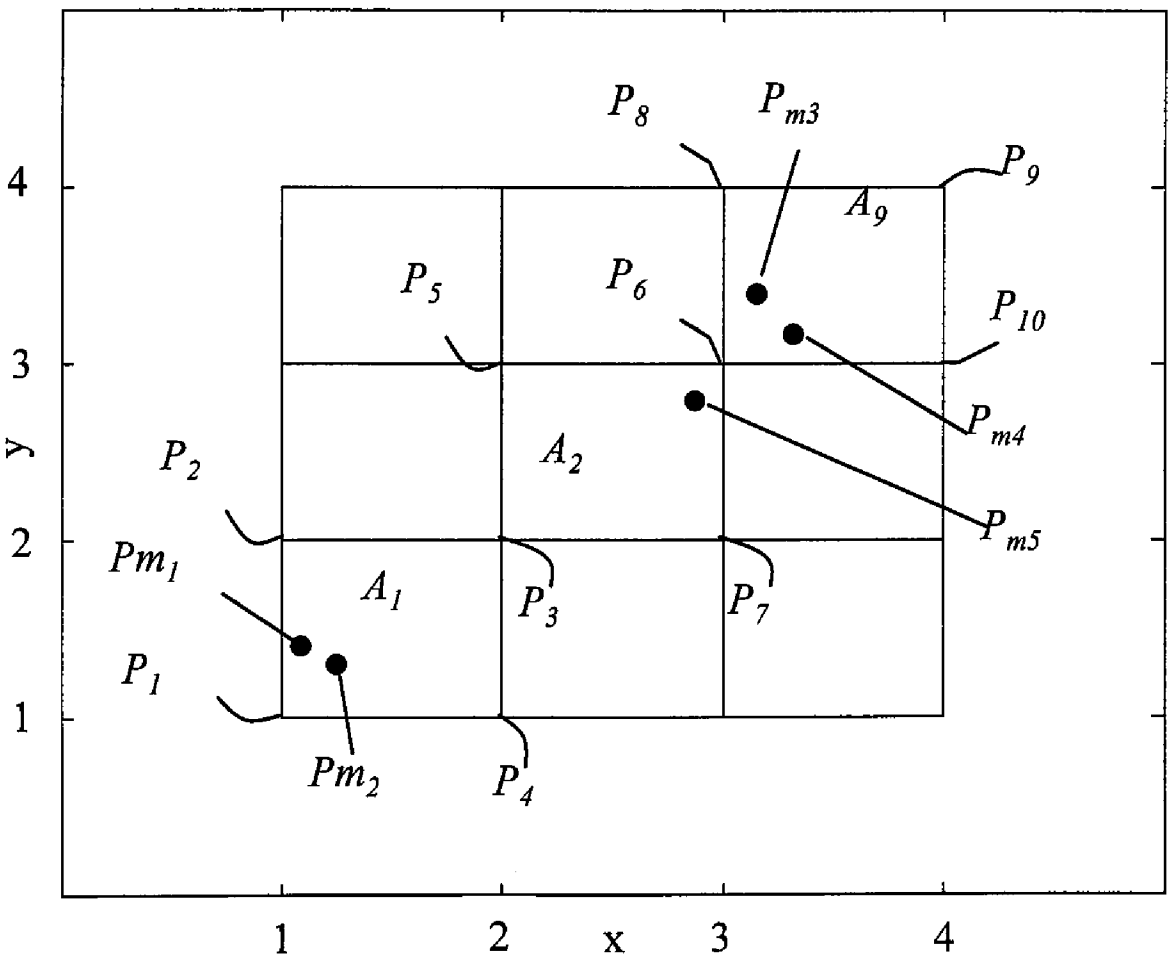
FIG. 4 shows an example of a calibration map structure obtained according to the method of the invention.

FIG. 4 shows a simplified example of a structure of map $M_n$ to be optimized.

In particular, as shown in FIG. 4, the coordinates of the input variables $I_{C1}$: [1,1], $I_{C2}$: [1,2], $I_{C3}$: [2,2] and $I_{C4}$: [2,1] are associated with calibration values $P_1$, $P_2$, $P_3$ and $P_4$ of map $M_n$; coordinates $I_{C5}$: [2,3], $I_{C6}$: [3,3], and $I_{C7}$: [3,2] are associated with values $P_5$, $P_6$ and $P_7$; and coordinates $I_{C8}$: [3,4], $I_{C9}$: [4,4] and $I_{C10}$: [4,3] are associated with calibration values $P_8$, $P_9$ and $P_{10}$.

After having defined the structure of map $M_n$, always with reference to FIG. 4, the processing unit 1 copies the measured experimental values for quantity $P_{ctrm}$, acquired by the processing unit 1 in block 4, into the structure of map $M_n$ and calculates the competence indices $I_C$ of each measured experimental value $P_{ctrm}$.

For example, still with reference to FIG. 4, measured experimental values $P_{ctrm1}$ and $P_{ctrm2}$ contribute to map points $P_1$, $P_2$ and $P_4$, while measured experimental values $P_{ctrm3}$, $P_{ctrm4}$ and $P_{ctrm5}$ contribute to map point $P_6$ and, similarly, measured experimental values $P_{ctrm3}$ and $P_{ctrm4}$ contribute to map points $P_8$, $P_9$ and $P_{10}$. This means that a change in the value of each map point will only influence the estimate value in relation to the competence indices; for example, the value of the map at point $P_1$ will only affect the estimate value in correspondence to points $P_{ctrm1}$ and $P_{ctrm2}$ and not at other points.

Again, with reference to FIG. 3, in the case in which map $M_n$ depends on a map $M_{n-1}$ already optimized by the algorithm 3 and for which the structure has already been defined, the YES exit is taken from block 10 and the processing unit 1 does not recalculate the structure of map $M_n$ at the beginning of each optimization, but uses the same competence indices $I_C$ and the same structure previously defined for the same map $M_n$, block 11.

Figure 5:
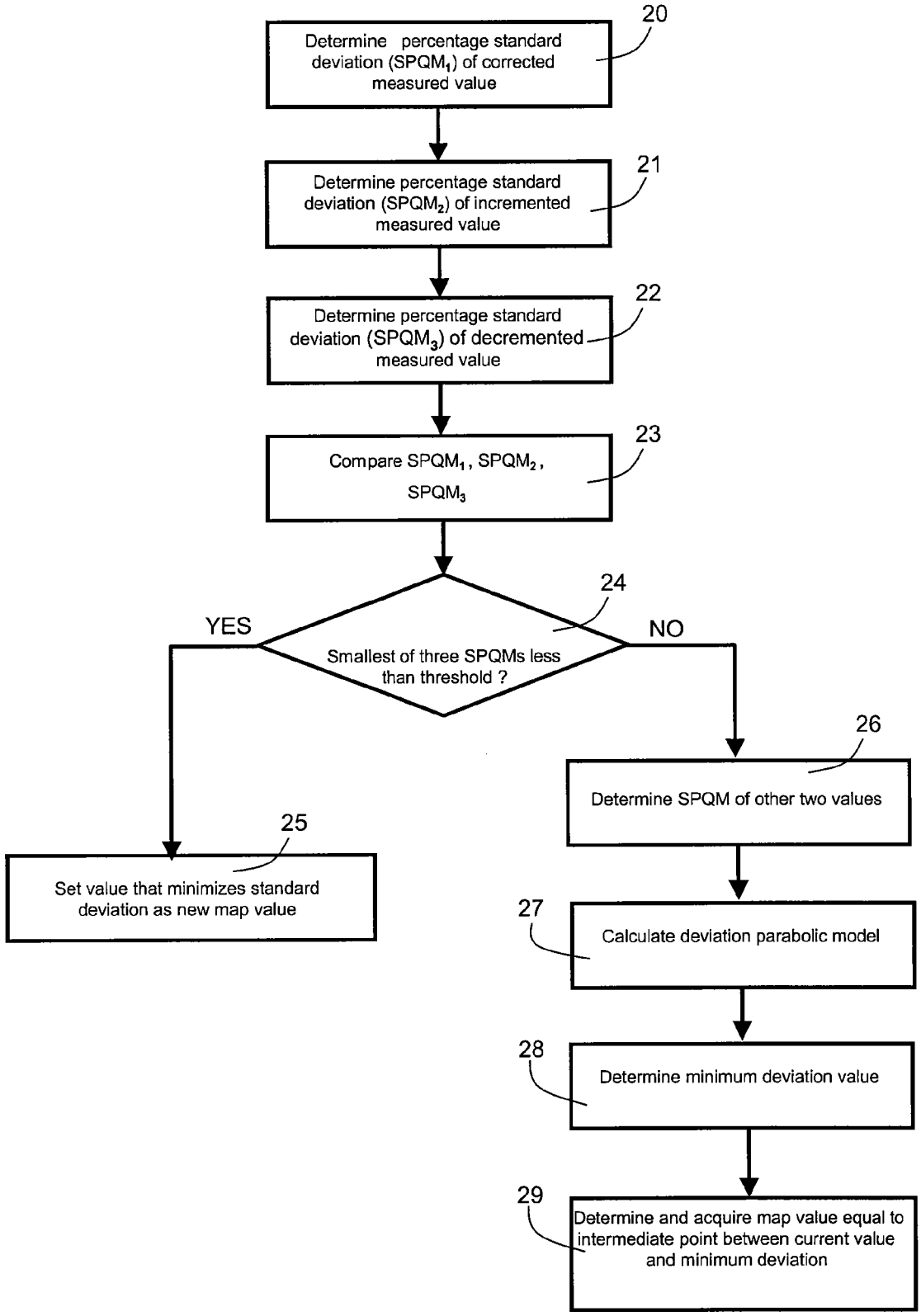

Then, the processing unit 1 identifies the measured values $P_{ctrm}$ specified in the structure of map $M_n$ that contribute to the single map point to be optimized, block 14, and implements an optimization procedure on each calibration value $P_{clb}$, according to the flowchart in FIG. 5.

In particular, as shown in block 20 in FIG. 5, the processing unit 1 corrects the measured quantity $P_{ctrm}$ with the respective calibration value $P_{clb}$ to which the competence index $I_C$ of the measured quantity $P_{ctrm}$ is associated, thereby determining the estimated quantity $P_{ctrs}$, and calculates the standard deviation $SQM_1$ between the measured quantity $P_{ctrm}$ and the quantity $P_{ctrs}$ estimated by the algorithm 2 with the current values of the map.

Then, in block 21, the processing unit 1:

- adds a factor F equal to the product K*De to the calibration value $P_{clb}$, where:
  - K is an integer chosen, randomly for example, from a preset range of integers, from 1 to 16 for example, and
  - De is a minimum variation allowed for the calibration quantity $P_{clb}$,
- in order to obtain a new calibration value $P_{clb+F}$,
- corrects the measured quantity $P_{ctrm}$ with the new calibration value $P_{clb+F}$ thereby determining a new value $P_{ctrs+F}$ for the estimated quantity, and
- calculates the standard deviation $SQM_2$ between the measured quantity $P_{ctrm}$ and the new estimated value $P_{ctrs+F}$ of the control quantity.

Successively, in block 22 the processing unit 1:

subtracts the factor F, equal to the product K*De from calibration value $P_{clb}$, obtaining a new calibration value $P_{clb-F}$, corrects the measured quantity $P_{ctrm}$ with the new calibration value $P_{clb-F}$ thereby determining a new value $P_{ctrs-F}$ for the estimated quantity, and calculates the standard deviation $SQM_3$ between the measured quantity $P_{ctrm}$ and the new estimated value $P_{ctrs-F}$ of the control quantity.

In block 23, the processing unit 1 determines the minimum standard deviation $SQM_{min}$ by selecting the smallest of the standard deviations $SQM_1$, $SQM_2$ and $SQM_3$, and compares the minimum standard deviation $SQM_{min}$ with a preset threshold value, for example 0.1.

In the case where the minimum standard deviation $SQM_{min}$ is below the threshold value, the YES exit is taken from block 24 and the processing unit 1 sets the one of the three calibration values $P_{clb}$, $P_{clb+F}$ and $P_{clb-F}$ having the standard deviation SQM closest to the minimum standard deviation $SQM_{min}$ in map $M_n$ as the optimal calibration value $P_{clb-ott}$, which will result as being the optimized calibration value, block 25.

Instead, in the case where the minimum standard deviation $SQM_{min}$ is greater than the threshold value, the NO exit is taken from block 24 and, in block 26, the processing unit 1 implements a calculation algorithm to obtain a value that is as close as possible to the minimum standard deviation $SQM_{min}$. To this end, the processing unit 1 calculates two calibration values $P_{clb2}$ and $P_{clb3}$ that tend towards an expected minimum calibration value $P_{clb-min}$ and determines the algebraic minimum of a curve that models the standard deviation $SQM_{min}$, implementing a parabolic model of deviation of known type, for example the "Levenberg Marquardt" algorithm, block 27.

In particular, to that end, the processing unit 1 calculates:

a calibration value $P_{clb2}$ that is at the minimum ($x_{min}=-b/2a$) of a parabolic equation $SQM=ax^2+bx+c$ passing through the points of standard deviation $SQM_1$, $SQM_2$ and $SQM_3$, a calibration value $P_{clb3}$ that is at the minimum ($x_{min}=-b/2a$) of a parabolic equation $SQM=ax^2+bx+c$ passing through the points defined by the values of standard deviation $SQM_1$, $SQM_2$ and $SQM_3$ and the calculated calibration point $P_{clb2}$, and determines the algebraic minimum of a curve that models the standard deviation $SQM_{min}$ on the basis of the points defined by the values of the standard deviations $SQM_1$, $SQM_2$, $SQM_3$, and by points $P_{clb2}$ and $P_{clb3}$.

Then, in block 28 the processing unit 1 substitutes, in map $M_n$, the value $P_{clb}$ used to correct the measured quantity $P_{ctrm}$ with a calibration value $P_{clb-ott}$ of map $M_n$ that is at an intermediate point between the calibration value $P_{clb}$ used to correct the measured quantity $P_{ctrm}$ and the algebraic minimum of the standard deviation $SQM_{min}$ determined by means of the parabolic model of deviation, which will thus constitute the optimized calibration value $P_{clb-ott}$, block 29.

After having optimized each one of the calibration values $P_{clb}$ of map $M_n$, again with reference to FIG. 3, the processing unit 1 implements a calculation procedure with the purpose of improving the distribution of the calibration values $P_{clb}$ within map $M_n$, block 16.

In particular, this procedure, for descriptive convenience henceforth referred to as "stretching" of the map $M_n$, consists in:

calculating a vector STR according to the formula:

$$STR_{(i)} = Y_{(i-1)} + \frac{(x_{(i)} - X_{(i-1)}) * (y_{(i+1)} - y_{(i-1)})}{x_{(i+1)} - x_{(i-1)}} - y_{(i)}$$

where:

X is a vector containing the values of the input quantity $P_i$ of the map, for example $X=[P_1\ P_2\ P_3\ P_4]$, Y is a vector containing each value of the calibration quantity $P_{clb}$ of the mono-dimensional map corresponding to a specific input value $P_i$, for example $Y=[P_{clb1}\ P_{clb2}\ P_{clb3}\ P_{clb4}]$, and i is the index that identifies the element of vector X or Y, (for example, Y(3) indicates the third element of vector Y), adding a quantity equal to η*STR/2 to value $P_{clb}$ of the map, where η is a stretching factor between a minimum value of zero corresponding to no stretching and a maximum value of 1 corresponding to maximum stretching, which can be set by the user, and subtracting a quantity equal to η*STR/4 from the neighbouring values $P_{clb-1}$ and $P_{clb+1}$ of the value $P_{clb}$ to calibrate.

The stretching procedure increases the continuity of the map, making it more faithful to the description of a physical phenomenon.

After having carried out the stretching procedure on the map $M_n$, again with reference to FIG. 3, in block 17 the processing unit 1 calculates: a minimum saturated value $P_{min-sat}$ on the basis of the minimum calibration value $P_{min}$ of map $M_n$, and a maximum saturated value $P_{max-sat}$ on the basis of the maximum calibration value $P_{max}$ of map $M_n$.

In particular, the minimum saturated value $P_{min-sat}$ of each calibration value of the map corresponds to the maximum value between the value of the map and the allowed minimum $P_{min}$, while the maximum saturated value $P_{min-sat}$ of each point of the map corresponds to the minimum value between the value of the map and the allowed maximum $P_{max}$.

The advantages that can be achieved with the present invention are evident from an examination of its characteristics.

First of all, the optimization of only one map at a time allows the optimized calibration value to be determined in an optimal manner, significantly reducing calculating times.

In addition, the identification of experimental points of competence for each map point outside of the optimization procedure and use of the Levenberg Marquardt algorithm only in cases where the calibration value is significantly different from its optimal value, allow a significant reduction in the execution times and complexity of the entire calculation procedure, at the same time preserving very good precision for the final result.

The implementation of the "stretching" procedure allows the most "continuous" calibration to be identified from a plurality of calibration values that roughly exhibit the same standard deviation.

Finally, it is clear that modifications and variants can be made to that described and shown herein without leaving the scope of protection of the present invention, as defined in the enclosed claims.

For example, instead of standard deviation SQM, the percentage standard deviation SPQM could be calculated, this being more indicated for solving problems where the requested precision specifications are provided in percentage terms rather than absolute ones.

The invention claimed is:

1. Method for controlling an internal combustion engine by optimizing calibration maps ($M_r$) for an algorithm of estimation of a control quantity ($P_{ctr}$) of the internal combustion engine, each calibration map comprising a plurality of calibration values ($P_{clb}$) of said control quantity ($P_{ctrs}$) estimated by said algorithm, the method comprising:

measuring the control quantity ($P_{ctrm}$), estimating the control quantity ($P_{ctrs}$) by means of said algorithm, and individually optimizing each calibration map ($M_n$) based on the measured control quantity ($P_{ctrm}$) and the estimated control quantity ($P_{ctrs}$), wherein optimizing each calibration map ($M_n$) comprises operating a computer to execute the steps of:

optimizing at least one of said plurality of calibration values ($P_{cbl}$), and distributing said optimized calibration values ($P_{clb\text{-}ott}$, ) in said calibration map (M~ based on a preset criterion, and wherein optimizing a calibration value ($P_{clb}$) comprises:

determining the estimated control quantity ($P_{ctrs}$) based on the measured control quantity ($P_{ctrm}$) and the calibration value ($P_{clb}$), computing a first standard deviation ($SQM_1$) between the measured control quantity ($P_{ctrm}$) and the estimated control quantity ($P_{ctrs}$), determining a first corrected calibration value ($P_{clb+F}$) based on the correction factor (F), determining the estimated control quantity ($P_{ctrs}$) based on the measured control quantity ($P_{ctrm}$) and the first corrected calibration value ($P_{clb+F}$), computing a second standard deviation ($SQM_2$) between the measured control quantity ($P_{ctrm}$) and the estimated control quantity ($P_{ctrs}$) based on the measured control quantity ($P_{ctrm}$) and the first corrected calibration value ($P_{clb+F}$), determining a second corrected calibration value ($P_{clb+F}$) based on the correction factor (F), determining the estimated control quantity ($P_{ctrs}$) based on the measured control quantity ($P_{ctrm}$) and the second corrected calibration value ($P_{clb+F}$), computing a third standard deviation ($SQM_3$) between the measured control quantity ($P_{ctrm}$) and the estimated control quantity ($P_{ctrs}$) based on the measured control quantity ($P_{ctrm}$) and the second corrected calibration value ($P_{clb+F}$), comparing the first ($SQM_1$), second ($SQM_2$) and third ($SQM_3$) standard deviations with each other and with a preset threshold value, and optimizing the calibration value ($P_{clb}$) based on said comparison; and utilizing the calibration value ($P_{clb}$) to control a function of the internal combustion engine.

2. Method according to claim 1, wherein the calibration factor (F) is determined based on an integer (K) within a preset range of integers and a preset minimum variation (De) of the calibration value ($P_{clb}$).

3. Method according to claim 2, wherein the calibration factor (F) is determined based on the product of said integer (K) within a preset range of integers and said preset minimum variation (De) of said calibration value ($P_{clb}$).

4. Method according to claim 1, wherein:

said first corrected calibration value ($P_{clb+F}$) is determined by adding said correction factor (F) to said calibration value ($P_{clb}$), and said second corrected calibration value ($P_{clb-F}$) is determined by subtracting said correction factor (F) from said calibration value ($P_{clb}$).

5. Method according to claim 1, wherein optimizing said calibration value ($P_{clb}$) based on said comparison comprises:

determining the smallest ($SPQM_{min}$) of said first ($SQM_1$), second ($SQM_2$) and third ($SQM_3$) standard deviations, comparing the smallest ($_{SPQMmin}$) standard deviation with said preset threshold value, and optimizing said calibration value ($P_{clb}$) based on said comparison.

6. Method according to claim 5, wherein when said smallest standard deviation ($SPQM_{min}$) is below said preset threshold value, optimizing said calibration value ($P_{clb}$) based on said comparison comprises:

setting in the calibration map an optimal calibration value ($P_{clb\text{-}ott}$) chosen among said calibration value ($P_{clb}$), said first corrected calibration value ($P_{clb+F}$), and said second corrected calibration value ($P_{clb-F}$), and for which the standard deviation (SQM) is closest to said smallest standard deviation ($SQM_{min}$).

7. Method according to claim 5, wherein when said smallest standard deviation ($_{SPQMmin}$) is higher than said preset threshold value, optimizing said calibration value ($P_{clb}$) based on said comparison comprises:

determining a first minimum calibration value ($P_{clb2}$), which is defined as the lowest point of a parabolic-like function passing through said first, second and third standard deviations ($SQM_1$, $SQM_2$ and $SQM_3$), determining a second minimum calibration value ($P_{clb3}$) which is defined as the lowest point of a parabolic-like function passing through said first, second and third standard deviations ($SQM_1$, $SQM_2$ and $SQM_3$) and said first calibration value ($P_{clb2}$), determining a minimum algebraic value of a function passing through said first, second and third standard deviations ($SQM_1$, $SQM_2$ and $SQM_3$) and said first and second minimum value ($P_{clb2}$ and $P_{clb3}$), and that models said smallest standard deviation ($SQM_{min}$), and substituting said calibration value ($P_{clb}$) in said calibration map with an optimal calibration value ($P_{clb\ ott}$) that is located at an intermediate point between said calibration value ($P_{clb}$) and said minimum algebraic value.

8. Method according to claim 7, wherein said minimum algebraic value is determined based on a "Levenberg Marquardt" algorithm.

9. Method according to claim 1, wherein distributing said plurality of optimized calibration values ($P_{clb\text{-}ott}$) in said map ($M_n$) comprises:

computing a stretching factor (STR) according to the formula: where:

X is a value of an input quantity ($P_i$) of said map,

Y is a calibration value ($P_{clb}$) corresponding to said value X of said input quantity ($P_i$), and I is an index that associates a value X of the input quantity ($P_i$) with the corresponding optimized calibration value ($P_{clb\text{-}ott}$), adding a quantity equal to η*STR/2 to each optimized calibration value ($P_{clb\text{-}ott}$), where η is a stretching factor between zero and one, and subtracting a quantity equal to η*STR/4 from adjacent values ($P_{clb-1}$ and $P_{clb+1}$) of said optimized calibration value ($P_{clb\text{-}ott}$).

10. A non-transitory computer readable medium containing a software code stored therein and loadable in a memory of a digital processor, said software code being configured to implement the method according to claim 1, when said software code is executed on said digital processor.

* * * * *